US012137862B1

(12) United States Patent
Ding et al.

(10) Patent No.: US 12,137,862 B1
(45) Date of Patent: Nov. 12, 2024

(54) PIVOTING AND LIFTING STRUCTURE WITH PUSH-PULL LOCKING, DISHWASHER, AND HOUSEHOLD APPLIANCE

(71) Applicant: SHENZHEN BAOJIA INTELLIGENCE CO., LTD, Shenzhen (CN)

(72) Inventors: Xiaowei Ding, Shenzhen (CN); Huadong Wu, Shenzhen (CN); Dongwei Wu, Shenzhen (CN); Yangzhong Lian, Shenzhen (CN); Shouwei Huang, Shenzhen (CN); Xiaoqing Wu, Shenzhen (CN)

(73) Assignee: SHENZHEN BAOJIA INTELLIGENCE CO., LTD, Shenzhen (CN)

( * ) Notice: Subject to any disclaimer, the term of this patent is extended or adjusted under 35 U.S.C. 154(b) by 0 days.

(21) Appl. No.: 18/657,717

(22) Filed: May 7, 2024

(30) Foreign Application Priority Data

Feb. 19, 2024 (CN) ..... 202410183710.6

(51) Int. Cl.
*A47L 15/50* (2006.01)

(52) U.S. Cl.
CPC ..... *A47L 15/506* (2013.01)

(58) Field of Classification Search
CPC ..... A47L 15/506
USPC ..... 134/143
See application file for complete search history.

(56) References Cited

FOREIGN PATENT DOCUMENTS

EP 3261489 B1 * 1/2019 ..... A47B 46/005
WO WO-2014033092 A1 * 3/2014 ..... A47B 46/005

OTHER PUBLICATIONS

WO2014033092A1—machine translation (Year: 2014).*
EP3261489B1—machine translation (Year: 2019).*

* cited by examiner

*Primary Examiner* — Tinsae B Ayalew
(74) *Attorney, Agent, or Firm* — Jason W. Croft; Buchalter

(57) ABSTRACT

A pivoting and lifting structure with push-pull locking, a dishwasher, and a household appliance are disclosed. To move the storage portion from an initial position to a position convenient for the user, the storage portion is first pulled out from the initial position. Then, the storage portion continues to be pulled to drive the swing portion to rotate to lift the storage portion. At this time, the guide portion is located at an inlet of a guide groove, enabling the guide portion to slide or roll along the guide groove. Therefore, the storage portion will not shake at the front and rear positions when it pivots upwards. Finally, the storage portion is pushed or pulled and the guide portion slides into the limiting groove to be in the locking position, preventing the guide portion returning in the direction opposite to the extension direction of the guide groove.

17 Claims, 9 Drawing Sheets

PIVOTING AND LIFTING STRUCTURE WITH PUSH-PULL LOCKING, DISHWASHER, AND HOUSEHOLD APPLIANCE

CROSS-REFERENCE TO RELATED APPLICATION

This application is based on and claims the benefit of priority from Chinese Patent Application No. 2024101837106, filed on 19 Feb. 2024, the entirety of which is incorporated by reference herein.

TECHNICAL FIELD

The present disclosure relates to the technical field of household appliance structures with movable storage structures, particularly to a pivoting and lifting structure with push-pull locking, a dishwasher, and a household appliance.

BACKGROUND

Household appliances with internal space, such as dishwashers, ovens, and refrigerators, are usually equipped with movable storage structures such as shelves, containers, cooking material holders, and storage boxes that can extend from the interior of the household appliances. Usually, such movable storage structures only have a pull-out function. However, in order to make the use of the household appliances more user-friendly and convenient, the movable storage structure at the lowest level not only has the pull-out function, but also has a lifting function, that is, the movable storage structure at the lowest level can be lifted up and down.

In the existing technology, in order to ensure that the movable storage structure can be maintained at a designated height after rising, a locking structure is usually configured. When the locking structure is in a locked state, the movable storage structure can be maintained at the designated height. Obviously, once the locking structure is configured, an additional unlocking structure needs to be configured to unlock the locking structure, so that a user can lower the movable storage structure and put it back into the lower level of the internal space. Currently, the unlocking structure requires additional settings, including but not limited to, motor-triggered unlocking, electromagnet-triggered unlocking, extended arm unlocking (unlocking the locking structure by manually pressing an extended lever), etc. Obviously, all the unlocking structures require additional costs, leading to higher costs for corresponding household appliances.

Therefore, it is necessary to develop a novel movable storage structure to address the technical problem that the current household appliances have high cost in meeting convenience requirements.

SUMMARY

An objective of the present disclosure is to provide a pivoting and lifting structure with push-pull locking, a dishwasher, and a household appliance to address the technical problem that the current household appliances have high cost in meeting convenience requirements.

To achieve the objective, the present disclosure adopts the following technical solutions.

A pivoting and lifting structure with push-pull locking includes:

a rotating assembly configured with a base portion and a swing portion, where the swing portion is hinged to the base portion and is rotatable around the base portion;

a sliding assembly including a sliding rail hinged to the swing portion, and a sliding portion slidingly connected to the sliding rail;

a first trigger assembly including a guide portion fixedly connected to the swing portion;

a second trigger assembly fixedly connected to the sliding portion and provided with a guide groove and a limiting groove corresponding to the guide portion;

where the sliding portion or the second trigger assembly is used to set a storage portion; the guide groove extends in a first direction so that the guide portion is capable of sliding or rolling along the guide groove when the swing portion rotates; and an extension direction of the limiting groove does not coincide with an extension direction of the guide groove at an outlet;

when the sliding portion extends out by a first distance and is in a first position, the guide portion is located at an inlet of the guide groove;

when the guide portion slides or rolls along the guide groove for a second distance and is in a second position, the guide portion is located at an inlet of the limiting groove; and when the guide portion is in a locking position, the guide portion is at least partially located in the limiting groove.

Optionally, the guide portion includes a first guide post and a second guide post, and the guide groove includes a first guide groove corresponding to the first guide post and a second guide groove corresponding to the second guide post;

when the sliding portion extends out by the first distance and is in the first position, the first guide post is located at an inlet of the first guide groove and is in contact with a groove wall of the first guide groove at the inlet, and the second guide post is not in contact with the second guide groove;

when the guide portion slides or rolls along the guide groove for the second distance and is in the second position, the second guide post is located in the second guide groove.

Optionally, the limiting groove is opened in a groove wall of the second guide groove;

when the guide portion slides or rolls along the guide groove for the second distance and is in the second position, the second guide post is capable of sliding into the limiting groove.

Optionally, the swing portion includes a first swing arm and a second swing arm rotationally connected to the base portion, and an end of the first swing arm and an end of the second swing arm are respectively hinged to the sliding rail;

where hinge points of the first swing arm and the second swing arm on the base portion, and hinge points of the first swing arm and the second swing arm on the sliding rail form a parallelogram.

Optionally, the second swing arm is provided with a corresponding buffer groove, a third swing arm is further rotationally connected to the second swing arm, the first guide post is mounted on the third swing arm, and the first guide post is slidingly connected to the buffer groove; and the second guide post is mounted on the second swing arm;

a reset unit is connected between the second swing arm and the third swing arm, where the reset unit is used to pull the third swing arm in a direction towards the second swing arm so that the first guide post is located in a first notch of the buffer groove; and when the sliding portion extends out by the first distance and is in the first position, the first guide post is pushed by the groove wall of the first guide groove, so that the first guide post is located in a second notch of the buffer groove.

Optionally, the base portion is further rotationally connected with a telescopic unit, and a telescopic end of the telescopic unit is rotationally connected with the first swing arm; and where a rotation direction of the telescopic unit acting on the first swing arm is opposite to an outward swing direction of the first swing arm before the sliding portion rotates by a first angle in the first direction;

after the sliding portion rotates by the first angle in the first direction, the rotation direction of the telescopic unit acting on the first swing arm is the same as the outward swing direction of the first swing arm.

Optionally, the base portion is provided with a limiting portion for limiting rotation of the swing portion; and before the sliding portion moves to the first position, the first swing arm is at least partially in contact with the second swing arm for limiting rotation of the swing portion in the direction opposite to the first direction.

Optionally, the extension direction of the limiting groove is opposite to a taking-out direction of the storage portion.

A dishwasher includes a storage portion and the pivoting and lifting structure with push-pull locking as described above, and the storage portion is a dishwasher rack.

A household appliance includes a storage portion and the pivoting and lifting structure with push-pull locking as described above, and the storage portion is a rack or a baking pan.

Compared with the existing technology, the present disclosure has the following beneficial effects.

The present disclosure provides a pivoting and lifting structure with push-pull locking, a dishwasher, and a household appliance. When it is needed to move the storage portion from an initial position to a position convenient for the user, the storage portion is first pulled out from an initial position, that is, the storage portion is located at the first position. Then, the storage portion continues to be pulled to drive the swing portion to rotate to lift the storage portion to the second position. Since the guide portion is now located at the inlet of the guide groove, it will slide or roll along the guide groove, so that the storage portion will not shake at the front and rear positions when it rotates upwards. Finally, the storage portion is pushed or pulled so that the guide portion slides into the limiting groove, that is, the storage portion is in the locking position, so that the guide portion cannot return in the direction opposite to the extension direction of the guide groove, completing the locking of the rotating assembly and the sliding assembly. For the above solution, the cooperation between the guide groove and the guide portion as well as the swing portion are first used to realize the guidance and lifting of the storage portion, and then the cooperation between the limiting groove and the guide portion is used to realize the locking of the storage portion, which can reduce the need of additional locking and unlocking devices while satisfying the convenience of use, resulting in reduced costs.

BRIEF DESCRIPTION OF DRAWINGS

In order to explain the embodiments of the present disclosure or the technical solutions in the existing technology more clearly, the drawings needed to be used in the description of the embodiments or the existing technology will be briefly introduced below. Apparently, the drawings in the following description are only some embodiments of the present disclosure. For those of ordinary skill in the art, other drawings can be obtained based on these drawings without making creative efforts.

The structures, proportions, sizes, etc. shown in the drawings of this specification are only intended to coordinate with the content disclosed in the specification and are for the understanding and reading of those familiar with this technology. They are not intended to limit the conditions under which the present disclosure can be implemented, and thus do not have any technical substantive significance. Any structural modifications, changes in proportions or adjustments in size shall still fall within the scope of the technical content disclosed in the present disclosure without affecting the effectiveness and purpose of the present disclosure.

DESCRIPTION OF REFERENCE NUMERALS

Figure 1:
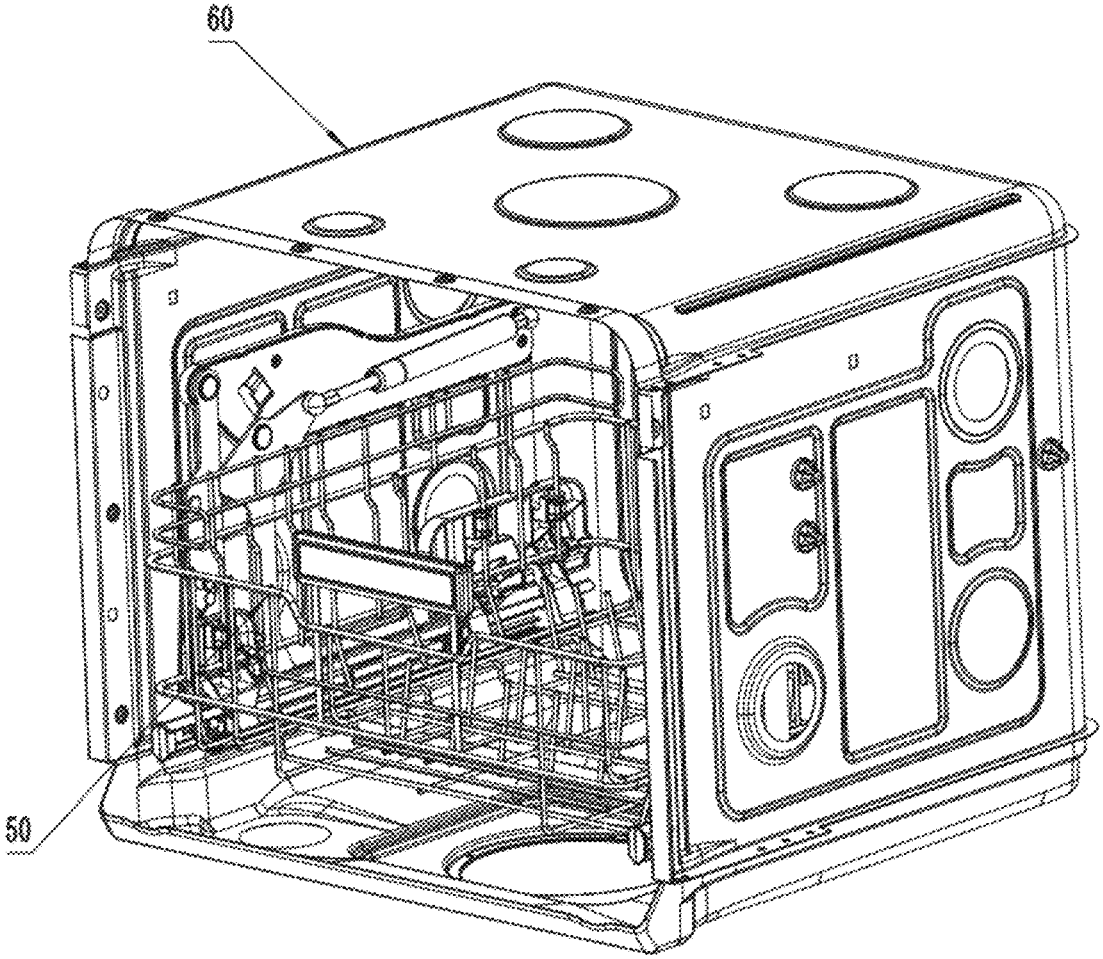
FIG. 1 is an overall structural schematic view of a pivoting and lifting structure with push-pull locking provided by the present disclosure.

10. rotating assembly; 110. base portion; 111. first rotating shaft; 112. second rotating shaft; 113. limiting portion; 120. swing portion; 130. first swing arm; 140. second swing arm; 141. buffer groove; 141*a*. first notch; 141*b*. second notch; 150. third swing arm; 160. reset unit; 170. telescopic unit;

20. sliding assembly; 210. sliding rail; 220. sliding portion; 230. third rotating shaft; 240. fourth rotating shaft; 250. fifth rotating shaft; 260. sixth rotating shaft;

30. first trigger assembly; 31. guide portion; 311. first guide post; 312. second guide post;

40. second trigger assembly; 401. guide groove; 4011. first guide groove; 4012. second guide groove; 402. limiting groove; 403. initial trigger block; 50. storage portion; 60. housing.

DETAILED DESCRIPTION

In order to make the objectives, features, and advantages of the present disclosure more apparent and understandable, the technical solutions in the embodiments of the present disclosure will be clearly and completely described below in conjunction with the drawings in the embodiments of the present disclosure. Apparently, the embodiments described below are only some, rather than all of the embodiments of the present disclosure. Based on the embodiments of the present disclosure, all other embodiments obtained by those of ordinary skill in the art without making creative efforts fall within the scope of protection of the present disclosure.

In the description of the present disclosure, it should be understood that the orientation or positional relationship indicated by the terms "upper", "lower", "top", "bottom", "inner", "outer", etc. is based on those shown in the drawings, which is only for the convenience of describing the present disclosure and simplifying the description, rather than indicating or implying that the device or element referred to must have a specific orientation, be constructed and operated in a specific orientation, and therefore cannot be understood as a limitation of the present disclosure. To be clear, when an assembly is considered to be "connected" to another assembly, it may be directly connected to another assembly or there may be an intermediate assembly at the same time.

The technical solutions of the present disclosure will be further described below in conjunction with the drawings and through specific implementations.

Figure 2:
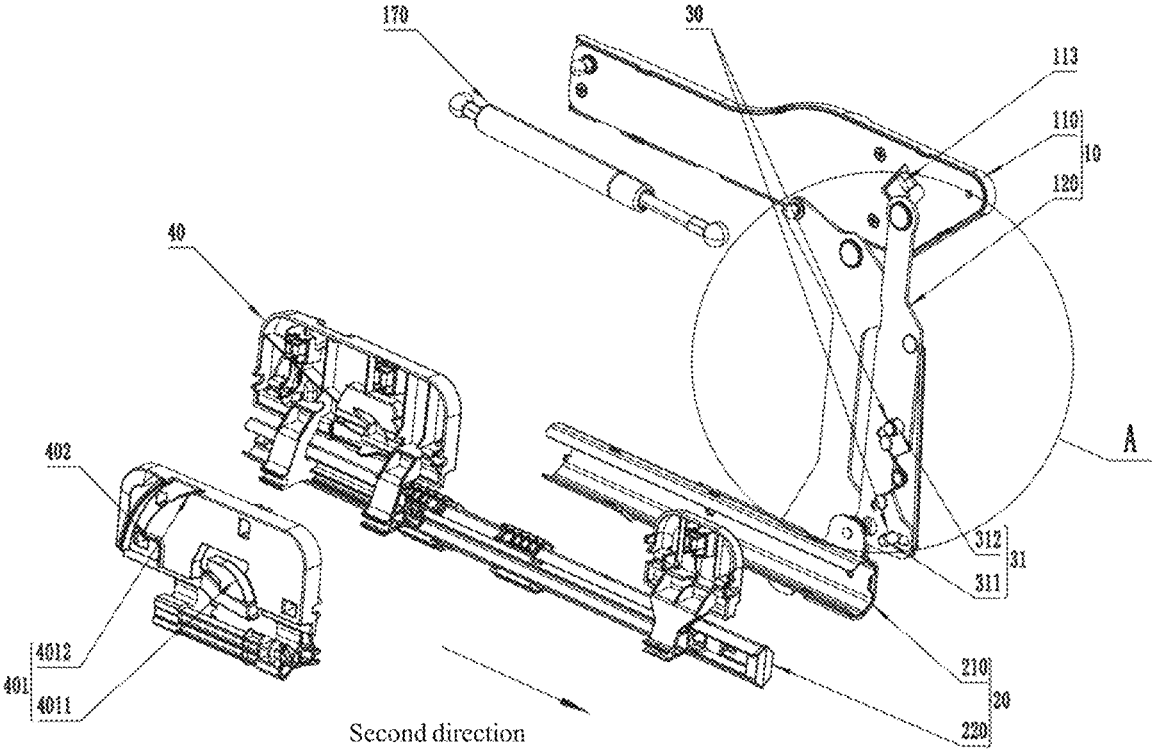
FIG. 2 is a partially exploded structural schematic view of the pivoting and lifting structure with push-pull locking provided by the present disclosure.
Figure 3:
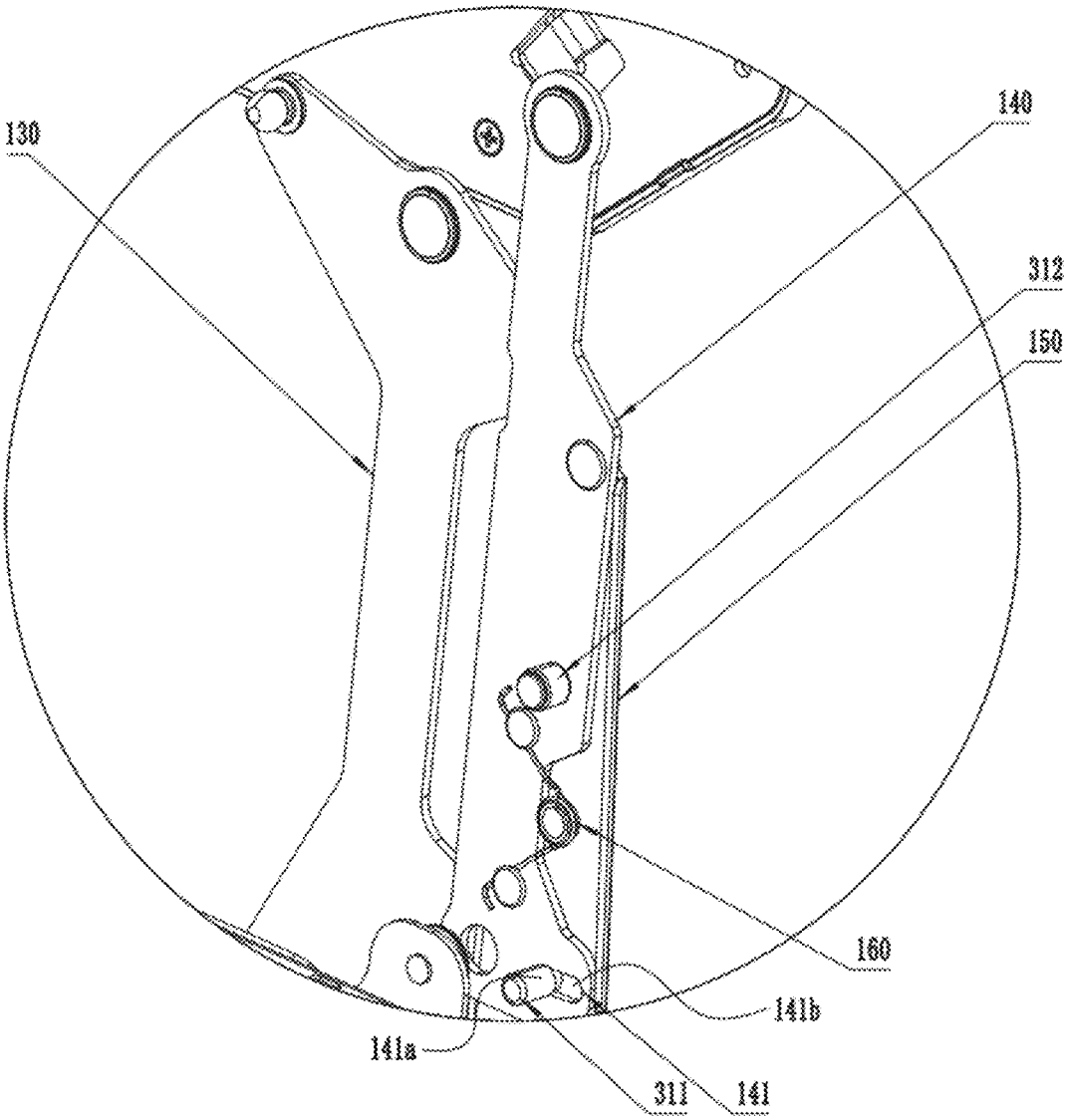
FIG. 3 is a partially enlarged structural schematic view of FIG. 2 at a position A.
Figure 4:
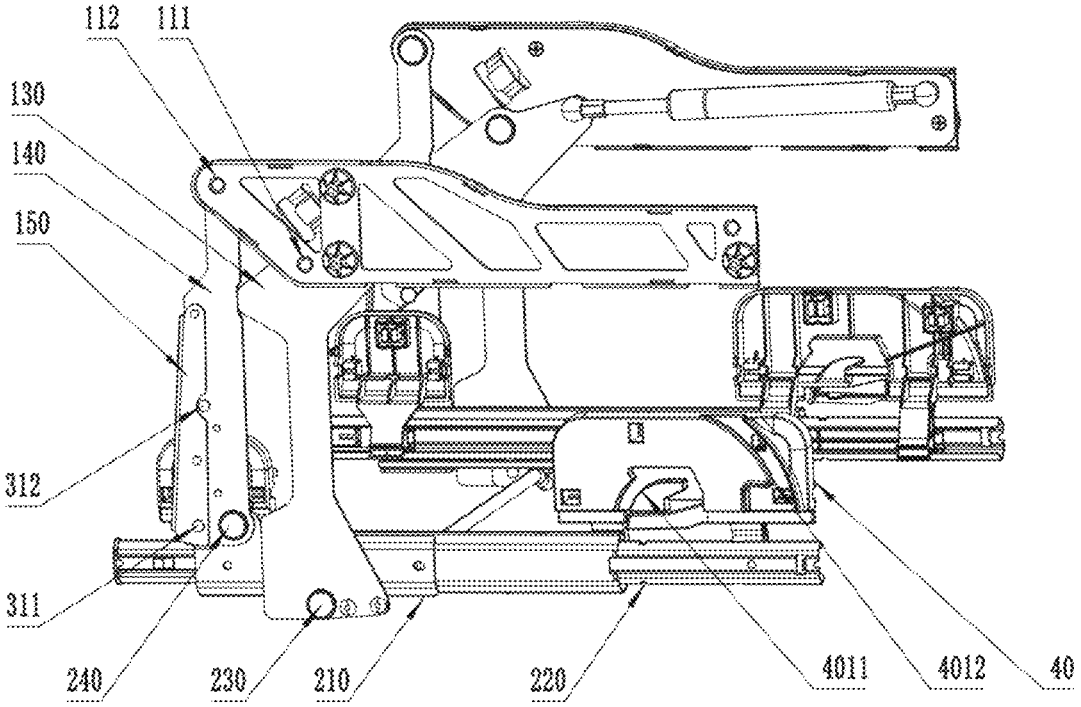
FIG. 4 is a schematic structural view of the pivoting and lifting structure with push-pull locking provided by the present disclosure in an initial state.
Figure 5:
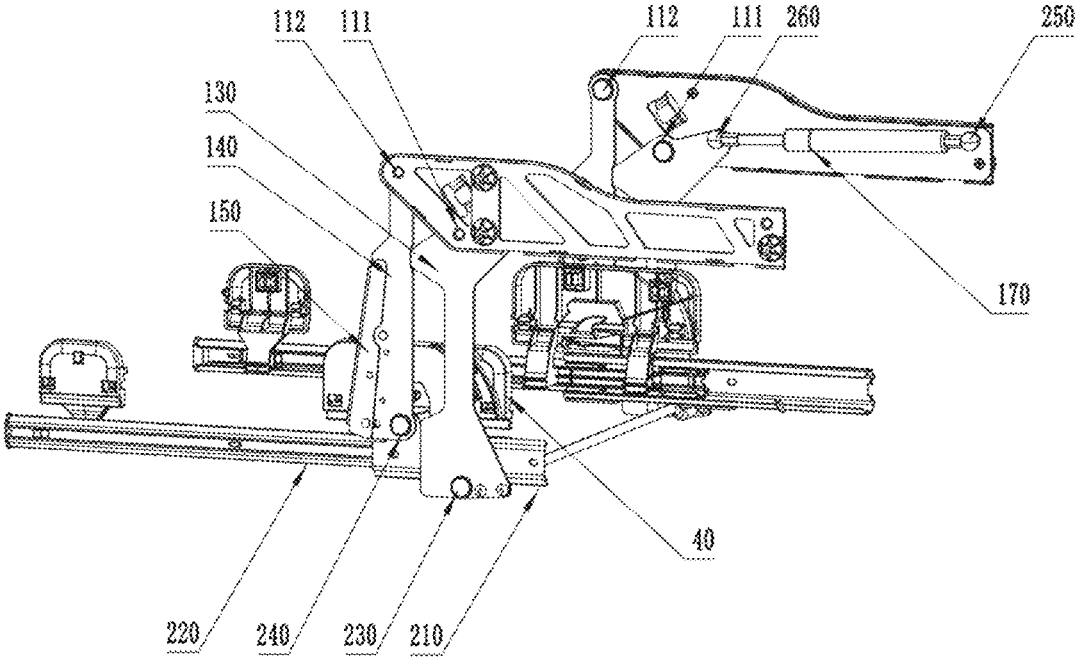
FIG. 5 is a schematic structural view of the pivoting and lifting structure with push-pull locking provided by the present disclosure in a first state.
Figure 6:
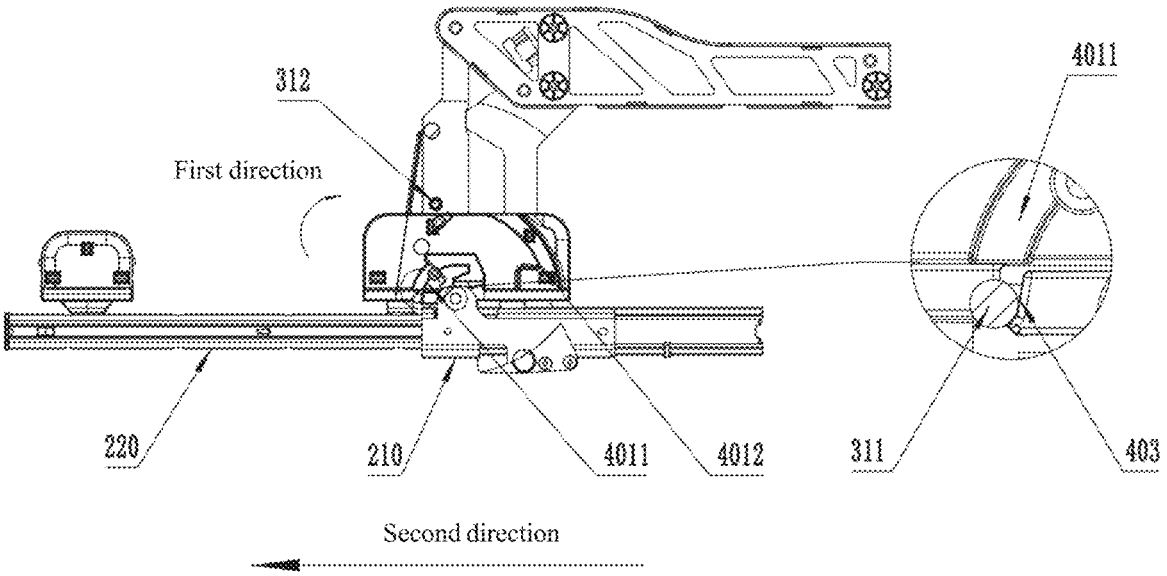
FIG. 6 is a schematic cross-sectional view of the pivoting and lifting structure with push-pull locking provided by the present disclosure in the first state.
Figure 7:
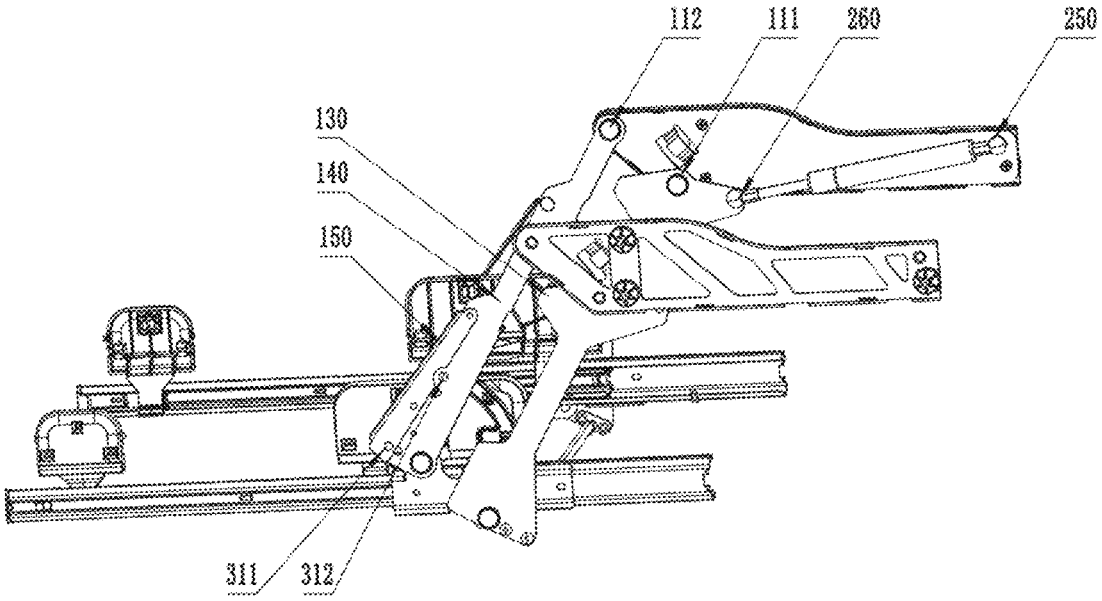
FIG. 7 is a schematic structural view of the pivoting and lifting structure with push-pull locking provided by the present disclosure in a transition state.
Figure 8:
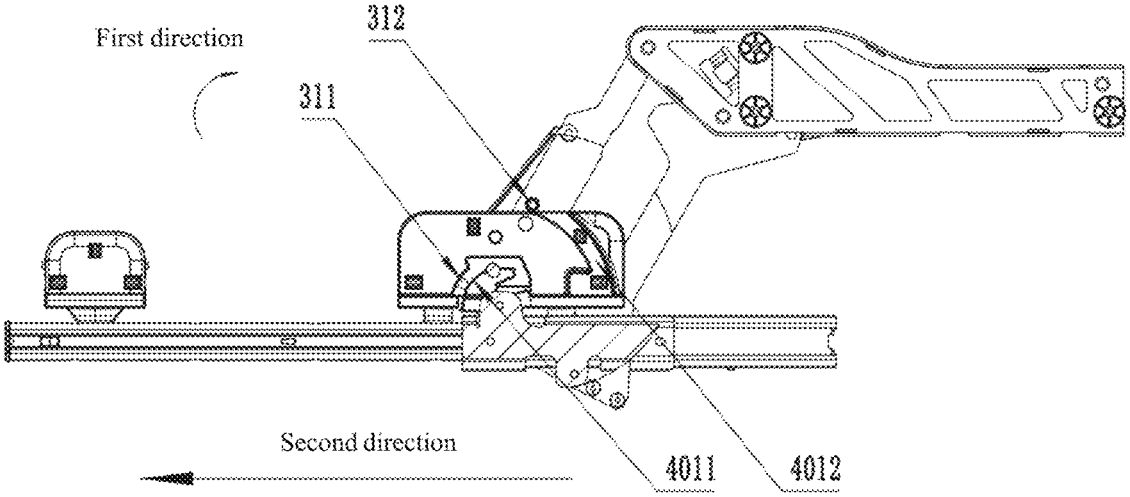
FIG. 8 is a schematic cross-sectional view of the pivoting and lifting structure with push-pull locking provided by the present disclosure in the transition state.
Figure 9:
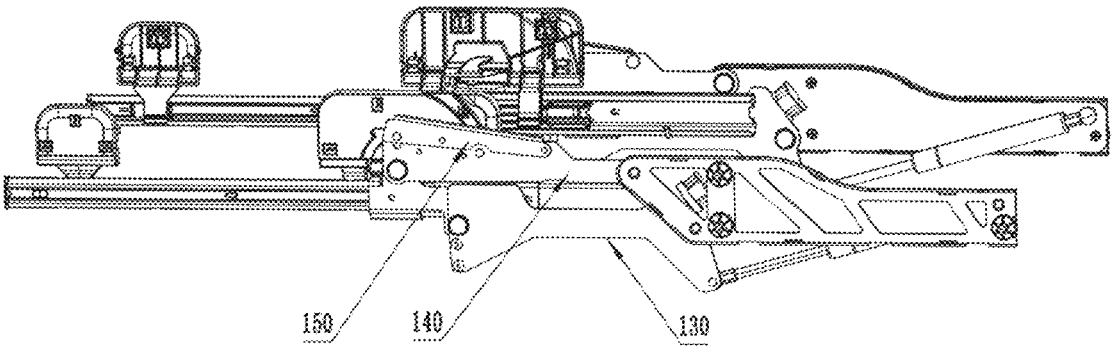
FIG. 9 is a schematic structural view of the pivoting and lifting structure with push-pull locking provided by the present disclosure in a second state.
Figure 10:
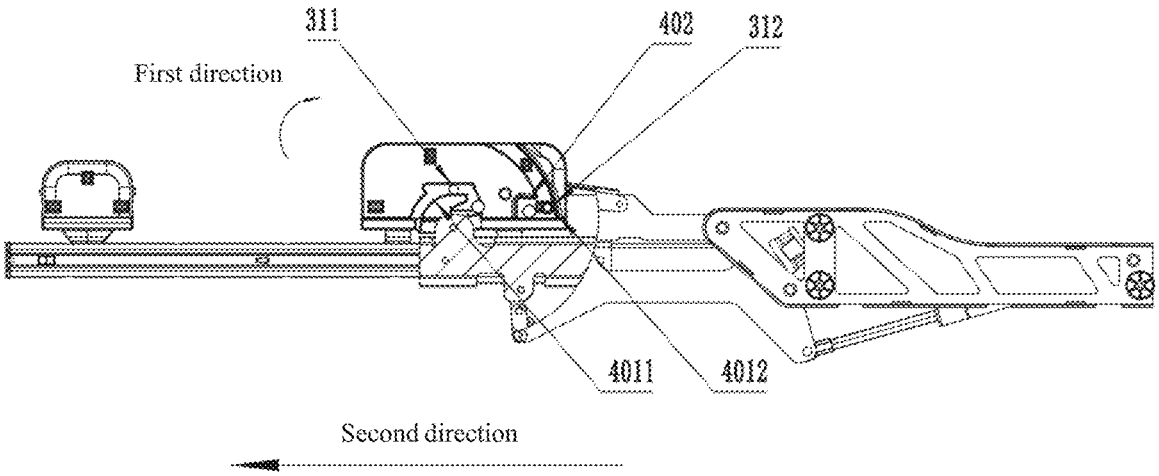
FIG. 10 is a schematic cross-sectional view of the pivoting and lifting structure with push-pull locking provided by the present disclosure in the second state.
Figure 11:
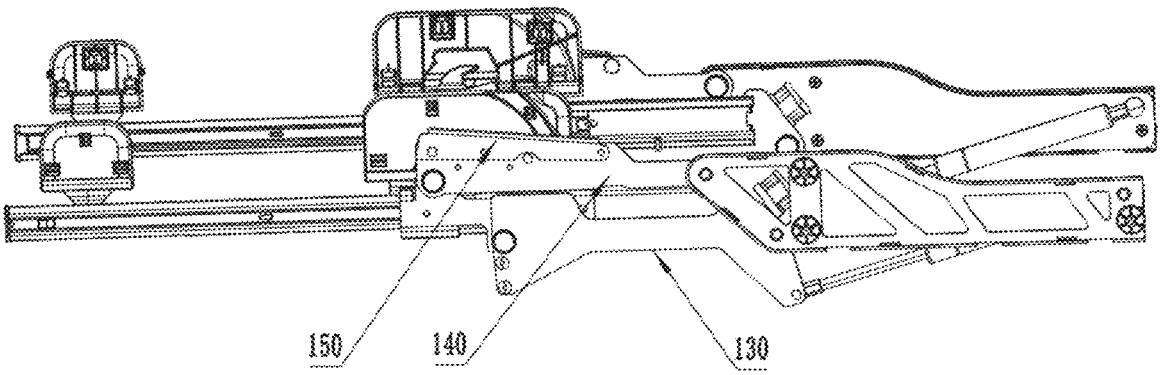
FIG. 11 is a schematic structural view of the pivoting and lifting structure with push-pull locking provided by the present disclosure in a third state.
Figure 12:
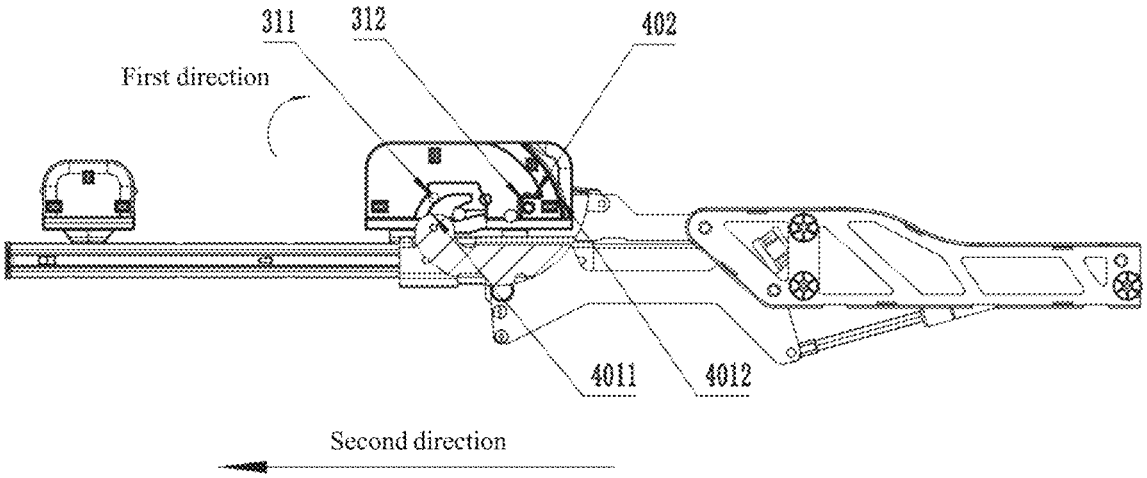
FIG. 12 is a schematic cross-sectional view of the pivoting and lifting structure with push-pull locking provided by the present disclosure in the third state.
Figure 13:
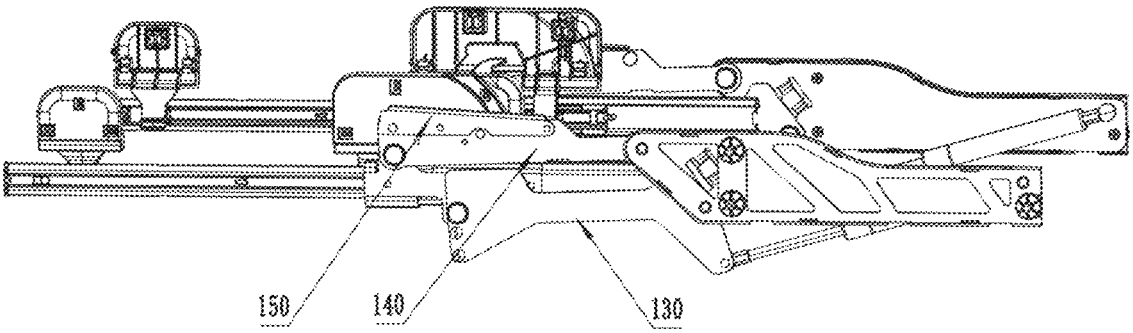
FIG. 13 is a schematic structural view of the pivoting and lifting structure with push-pull locking provided by the present disclosure in a fourth state.
Figure 14:
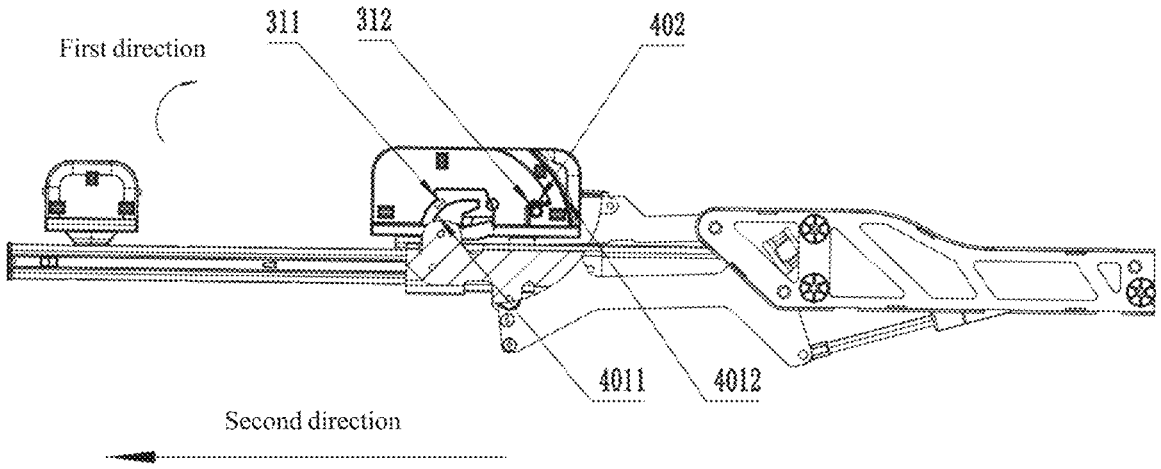
FIG. 14 is a schematic cross-sectional view of the pivoting and lifting structure with push-pull locking in the fourth state provided by the present disclosure.

As shown in FIGS. 1-14, FIG. 1 is an overall structural schematic view of a pivoting and lifting structure with push-pull locking provided by the present disclosure, FIG. 2 is a partially exploded structural schematic view of the pivoting and lifting structure with push-pull locking provided by the present disclosure, FIG. 3 is a partially enlarged structural schematic view of FIG. 2 at a position A, FIG. 4 is a structural schematic view of the pivoting and lifting structure with push-pull locking provided by the present disclosure in an initial state, FIG. 5 is a schematic structural view of the pivoting and lifting structure with push-pull locking provided by the present disclosure in a first state, FIG. 6 is a schematic cross-sectional view of the pivoting and lifting structure with push-pull locking provided by the present disclosure in the first state, FIG. 7 is a schematic structural view of the pivoting and lifting structure with push-pull locking provided by the present disclosure in a transition state, FIG. 8 is a schematic cross-sectional view of the pivoting and lifting structure with push-pull locking provided by the present disclosure in the transition state, FIG. 9 is a schematic structural view of the pivoting and lifting structure with push-pull locking provided by the present disclosure in a second state, FIG. 10 is a schematic cross-sectional view of the pivoting and lifting structure with push-pull locking provided by the present disclosure in the second state, FIG. 11 is a schematic structural view of the pivoting and lifting structure with push-pull locking provided by the present disclosure in a third state, FIG. 12 is a schematic cross-sectional view of the pivoting and lifting structure with push-pull locking provided by the present disclosure in the third state, FIG. 13 is a schematic structural view of the pivoting and lifting structure with push-pull locking provided by the present disclosure in a fourth state, and FIG. 14 is a schematic cross-sectional view of the pivoting and lifting structure with push-pull locking provided by the present disclosure in a fourth state.

Embodiment One

The pivoting and lifting structure with push-pull locking provided by this embodiment can be used in household appliances with internal space such as dishwashers, ovens, and refrigerators, and can realize the sliding and lifting of the movable storage structures such as shelves, containers, cooking material holders, and storage boxes. In this embodiment, the pivoting and lifting structure with push-pull locking is optimized to reduce the cost.

As shown in FIGS. 1-4, the pivoting and lifting structure with push-pull locking in this embodiment includes a rotating assembly 10, a sliding assembly 20, a first trigger assembly 30, and a second trigger assembly 40. The rotating assembly 10 is configured with a base portion 110 and a swing portion 120, where the base portion 110 can be fixedly connected to the housing 60 as an independent sheet metal part. The base portion 110 may also be a part of the housing 60 (for example, a plate integrally welded to the housing 60), and the swing portion 120 is hinged to the base portion 110 and rotates around the base portion 110. The sliding assembly 20 includes a sliding rail 210 hinged to the swing portion 120 and a sliding portion 220 slidingly connected to the sliding rail 210. As shown in FIGS. 4-6, the sliding portion 220 can slide along the sliding rail 210 in a second direction, which is equivalent to the withdrawal of the storage portion 50 from the housing 60. As shown in FIGS. 6-10, the swing portion 120 can swing from a first state to a second state. At this time, the swing portion 120 swings obliquely upwards relative to the housing 60, which is equivalent to lifting the overall height of the sliding rail 210, i.e., lifting the height of the storage portion 50.

The first trigger assembly 30 includes a guide portion 31 fixedly connected to the swing portion 120. The second trigger assembly 40 is fixedly connected to the sliding portion 220, and has a guide groove 401 and a limiting groove 402 corresponding to the guide portion 31. That is, the second trigger assembly 40 can slide simultaneously with the sliding portion 220.

The sliding portion 220 or the second trigger assembly 40 is used to set the storage portion 50 by methods including but not limited to snap connection, integrated connection, etc. The guide groove 401 extends in the first direction, so that the guide portion 31 is capable of sliding or rolling along the guide groove 401 when the swing portion 120 rotates. The first direction is a swing direction of the swing portion 120. When the swing portion 120 swings obliquely upwards in the first direction, it slides or rolls in the guide groove 401 through the connected guide portion 31, and can limit the position of the second trigger assembly 40, that is, the storage portion 50 and the second trigger assembly 40 are prevented from shaking back and forth in the second direction during the movement to the second position (i.e., during the rising process). That is, the stability of the swing portion 120 is improved by setting the guide portion 31 and the guide groove 401. Meanwhile, an extension direction of the limiting groove 402 does not coincide with an extension direction of the guide groove 401 at the outlet, which means that if the guide portion 31 enters the limiting groove 402, it is difficult for the guide portion 31 to directly reset along the guide groove 401. For example, when the user pulls the storage portion 50 to provide it in a second position (as shown in FIGS. 9-10), the swing portion 120 rotates by a certain angle in the first direction, so that the guide portion 31 is located at the outlet of the guide groove 401, which is located at the junction of the guide groove 401 and the limiting groove 402. At this time, the user can push/pull the storage portion 50 to slide the guide portion 31 into the limiting groove 402 accordingly. Since the extension direction of the limiting groove 402 does not coincide with the extension direction of the guide groove 401 at the outlet, unlocking can only be achieved unless the user applies an external force to the storage portion 50 and pulls/pushes the storage portion 50 so that the guide portion 31 returns to the guide groove 401. That is to say, only after the user unlocks the storage portion 50 by pulling/pushing it, the storage portion 50 and its load can be used to make the guide portion 31 return to the inlet of the guide groove 401, or the user can additionally press the storage portion 50 to make the guide portion 31 return to the inlet of the guide groove 401 so as to lower the height of the storage portion 50.

Specifically, as shown in FIGS. 4-6, when the sliding portion 220 extends out by a first distance and is in the first position, the pivoting and lifting structure with push-pull locking is in the first state, and the guide portion 31 is located at the inlet of the guide groove 401. At this time, the guide portion 31 is in contact with the groove wall of the guide groove 401 at the inlet. The groove wall of the guide groove 401 at the inlet is an initial trigger block 403 in FIG. 6. The initial trigger block 403 is equivalent to a part of the inlet of the guide groove 401. Therefore, when the initial trigger block 403 is in contact with the guide portion 31, it means that the storage portion 50 extends out of the housing 60 by the first distance, and the taking-out of the storage portion 50 is completed. As shown in FIGS. 5-10, when the guide portion 31 slides along the guide groove 401 for a second distance and is in the second position, the guide portion 31 is located at the inlet of the limiting groove 402, and the guide portion 31 is capable of sliding into the limiting groove 402. At this time, the guide portion 31 rotates in the first direction, which also means that the swing portion 120 rotates in the first direction, that is, swings outwards, thereby increasing the height of the storage portion 50. Next, as shown in FIGS. 9-14, when the guide portion 31 is in the locking position (i.e., the third position or the fourth position), the guide portion 31 is at least partially located in the limiting groove 402, that is, the guide portion 31 is capable of sliding into the limiting groove 402 by pushing or pulling the storage portion 50 to lock the storage portion 50.

Therefore, in the pivoting and lifting structure with push-pull locking in this embodiment, when the storage portion 50 needs to be moved from the initial position (the position shown in FIG. 4) to a position convenient for the user (the position shown in FIGS. 11-14), the sliding portion 220 is first pulled to extend out by the first distance, that is, the storage portion 50 is in the first position, and pulled out from the initial position. Then, the guide portion 31 is now located at the inlet of the guide groove 401, and the storage portion 50 continues to be pulled, driving the swing portion 120 to rotate, so as to lift the storage portion 50 to the second position, causing the guide portion 31 to slide or roll along the guide groove 401, so that the storage portion 50 will not shake at the front and rear positions when it pivots upwards. Finally, the storage portion 50 is pushed or pulled to make the guide portion 31 slide into the limiting groove 402, that is, the storage portion 50 is in the locking position, so that the guide portion 31 cannot return in the direction opposite to the extension direction of the guide groove 401, thus completing the locking of the rotating assembly 10 and the sliding assembly 20. For the above solution, the cooperation between the guide groove 401 and the guide portion 31 as well as the swing portion 120 are first used to guide and lift the storage portion 50, and then the cooperation between the limiting groove 402 and the guide portion 31 is used to realize the locking of the storage portion 50, which can reduce the need for additional locking and unlocking devices while satisfying the convenience of use, resulting in reduced costs.

Further, as shown in FIGS. 1-3, the guide portion 31 includes a first guide post 311 and a second guide post 312, and the guide groove 401 includes a first guide groove 4011 corresponding to the first guide post 311 and a second guide groove corresponding to the second guide post 311. As shown in FIGS. 4-6, when the sliding portion 220 extends out by the first distance and is in the first position, the first guide post 311 is in contact with the groove wall of the first guide groove 4011 at the inlet, that is, the first guide post 311 is in contact with the initial trigger block 403, and the second guide post 312 is not in contact with the second guide groove 4012. As shown in FIGS. 7-8, when the guide portion 31 slides for the second distance along the guide groove 401 and is in the second position, the second guide post 312 is located in the second guide groove 4012.

It can be understood that during the lifting process of the storage portion 50, the first half guide pin (the first guide post 311) first slides into the first guide groove 4011. After the storage portion 50 rises to a certain position, the second guide post 312 slides into the second guide groove 4012. The first guide post 311 and the second guide post 312 work cooperatively, so that the storage portion 50 will not easily shake back and forth (i.e., shaking in the second direction) in the lifting process.

Based on the above embodiment, the limiting groove 402 is opened in the groove wall of the second guide groove 4012. As shown in FIGS. 9-10, when the guide portion 31 slides for the second distance along the guide groove 401 and is in the second position, the second guide post 312 is capable of sliding into the limiting groove 402.

It should be added that in the second direction, the first guide groove 4011 is located outside the second guide groove 4012, and the cooperation between the first guide groove 4011 and the first guide post 311 is first utilized. This means that in the first state, the first guide post 311 is first in contact with the groove wall of the first guide groove 4011. Since the contact position is located at a lower front of the second trigger assembly 40, when the user pulls the storage portion 50, the point where the force is applied to the swing portion 120 is further away from the base portion 110, that is, the force arm is relatively long, which can save the user's effort to overcome the locking force of the telescopic unit 170 described later, so that the user can pull the storage portion 50 up more easily. After the storage portion 50 is pulled up to a certain distance, as shown in FIGS. 7-8, the second guide post 312 is about to enter the second guide groove 4012, which can further reduce the overall back and forth shaking in the second direction, thereby further improving the stability of the lifting of the storage portion 50. Then, as shown in FIGS. 9-10, the second guide post 312 can enter the limiting groove 402 to lock the position of the storage portion 50. It should be pointed out that in this embodiment, through the arrangement of the first guide post 311 and the first guide groove 4011 and the arrangement of the second guide post 312 and the second guide groove 4012, it is possible to effectively reduce the overall back and forth shaking in the second direction, prevent the storage portion 50 from getting stuck during movement, and further optimize the user experience when lifting and locking the height of the storage portion 50.

As other optional embodiment, the limiting groove 402 may be opened in the groove wall of the first guide groove 4011. For example, when the user pulls the storage portion 50 up from the first position to the second position, the first guide post 311 slides along the first guide groove 4011 in the first direction. When the storage portion 50 is moved from the second position to the locking position, the storage portion 50 can be pushed or pulled in the extension direction of the limiting groove 402, so that the first guide post 311 enters the limiting groove 402, and the position locking for the storage portion 50 can also be achieved.

Further, the swing portion 120 includes a first swing arm 130 and a second swing arm 140 that are rotationally connected to the base portion 110. An end of the first swing arm 130 and an end of the second swing arm 140 are respectively hinged to the sliding rail 210. The hinge points of the first swing arm 130 and the second swing arm 140 on the base portion 110 and the hinge points of the first swing arm 130 and the second swing arm 140 on the sliding rail 210 form a parallelogram. Specifically, the first swing arm 130 is hinged to the base portion 110 through a first rotating shaft 111, the first swing arm 130 is hinged to the sliding rail 210 through a third rotating shaft 230, the second swing arm 140 is hinged to the base portion 110 through a second rotating shaft 112, and the second swing arm 140 is hinged to the sliding rail 210 through a fourth shaft 240. The above four rotating shafts are arranged in a parallelogram shape, which means that the connection line between the first rotating shaft 111 and the second rotating shaft 112 is always parallel to the connection line between the third rotating shaft 230 and the fourth rotating shaft 240, indicating that the angle of the connection line between the third rotating shaft 230 and the fourth rotating shaft 240 with respect to the second direction remains constant. The sliding rail 210 is rotationally connected to the third rotating shaft 230 and the fourth rotating shaft 240 respectively, indicating that the angle of the sliding rail 210 with respect to the second direction always remains constant. On this basis, the sliding rail 210 can always be parallel to the second direction to ensure that the storage portion 50 is always kept horizontal when the user changes the position of the storage portion 50, reducing the tipping of items in the storage portion 50.

As an optional embodiment, as shown in FIGS. 2-14, the second swing arm 140 is provided with a corresponding buffer groove 141. The buffer groove 141 includes a first notch 141*a* and a second notch 142*b*. A third swing arm is further rotationally connected to the second swing arm 140, the first guide post 311 is mounted on the third swing arm 150, and the first guide post 311 is slidingly connected to the buffer groove 141. The second guide post 312 is mounted on the second swing arm 140. A reset unit 160 is connected between the second swing arm 140 and the third swing arm 150. The reset unit 160 is used to pull the third swing arm 150 in a direction towards the second swing arm 140 so that the first guide post 311 is located at one end of the buffer groove 141, that is, the first guide post 311 is located in the first notch 141*a*. One end of the buffer groove 141 and the other end of the buffer groove 141 are sequentially arranged in the second direction, that is, the first notch 141*a* and the second notch 142*b* are sequentially arranged in the second direction. In this embodiment, a torsional spring unit is selected for the reset unit 160, which can provide a constant reset torque. As other optional embodiments, other elastic structures such as tension springs may be selected for the reset unit. The reset unit 160 is capable of applying a force to the third swing arm 150 so that the first guide post 311 tends to move towards the first notch 141*a* of the buffer groove 141.

Specifically, as shown in FIGS. 2-4, before the sliding portion 220 extends out by the first distance, the first guide post 311 is located at one end of the buffer groove 141, that is, at the first notch 141*a*. As shown in FIGS. 5-6, when the sliding portion 220 extends out by the first distance and is in the first position, the first guide post 311 is pushed by the groove wall of the first guide groove 4011, that is, the first guide post 311 is pushed by the initial trigger block 403 so that the first guide post 311 is located at the other end of the buffer groove 141, that is, the first guide post 311 is located at the second notch 141*b*. When the user pulls the storage portion 50 to the first position, due to the presence of the reset unit 60, the sudden collision between the initial trigger block 403 and the first guide post 311 can be avoided, providing the user with a cushioning feel, and avoiding collisions between items within the storage portion 50.

A telescopic unit 170 is also rotationally connected to the base portion 110, and the telescopic end of the telescopic unit 170 is rotationally connected to the first swing arm 130. A structure such as a gas spring, a cylinder unit, an oil cylinder unit, a compression spring and the like may be selected for the telescopic unit 170. In this embodiment, the gas spring is preferred. As shown in FIGS. 4-6, before the sliding portion 220 rotates by a first angle in the first direction, the rotation direction of the telescopic unit 170 acting on the first swing arm 130 is opposite to the outward swing direction of the first swing arm 130. When the sliding portion 220 rotates by the first angle in the first direction, the rotation direction of the telescopic unit 170 acting on the first swing arm 130 is the same as the outward swing direction of the first swing arm 130. The first direction is an extension direction of the first guide groove 4011. When the first guide post 311 rolls or slides in the first guide groove 4011 in the first direction, there is a first angle such that the first guide post 311 rotates by the first angle correspondingly. This causes the first swing arm 130 and the second swing arm 140 to rotate by the first angle, thereby driving the sliding rail 210 and the sliding portion 220 to rotate by the first angle. In addition, when the first swing arm 130 rotates, it will also drive the hinge point (a sixth rotating shaft 260) of the first swing arm 130 and the telescopic end of the telescopic unit 170 to rotate, and at this angle, the extension direction of the telescopic unit 170 coincides with the first rotating shaft 111. That is to say, when the sliding portion 220 rotates by the first angle in the first direction, the extension direction of the telescopic unit 170 coincides with the first rotating shaft 111, which means that the rotation direction of the telescopic unit 170 acting on the first swing arm 130 is about to change from being opposite to the outward swinging direction of the first swing arm 130 to being the same as the outward swinging direction of the first swing arm 130.

Specifically, as shown in FIGS. 4-6, the fixed end of the telescopic unit 170 is rotationally connected to the base portion 110 through a fifth rotating shaft 250, and the telescopic end of the telescopic unit 170 is rotationally connected to the first swing arm 130 through a sixth rotating shaft 260. As shown in FIGS. 4-6, before the guide portion 31 slides along the guide groove 401, the sixth rotating shaft 260 is located above the line connecting the fifth rotating shaft 250 and the first rotating shaft 111, so that the rotation direction of the telescopic unit 170 acting on the first swing arm 130 is opposite to the outward swing direction (i.e., the first direction) of the first swing arm 130, that is, the rotation direction of the telescopic unit 170 acting on the first swing arm 130 is opposite to the first direction. At this time, the telescopic unit 170 functions to lock the first swing arm 130 and the second swing arm 140, so that the user can lift the storage portion 50 only when he overcomes the locking force of the telescopic unit 170, thereby preventing the rotation of the swing portion 120 in the first direction easily when the storage portion 50 is pulled in the second direction. That is to say, during the movement of the storage portion 50 from the initial position to the first position, the telescopic unit 170 can apply a torque opposite to the first direction on the first swing arm 130 to prevent the first swing arm 130 from lifting in advance and avoid parts interfering with each other (for example, physical collision between the lower storage portion 50 and the upper storage portion 50), thus improving the overall service life. After the sliding portion 220 rotates by the first angle in the first direction, the sixth rotating shaft 260 is located on the line connecting the fifth rotating shaft 250 and the first rotating shaft 111, which means that the rotation direction of the telescopic unit 170 acting on the first swing arm 130 is about to change from being opposite to the outward swing direction of the first swing arm 130 to being the same as the outward swing direction of the first swing arm 130. As shown in FIGS. 7-14, when the guide portion 31 slides along the guide groove 401, the sixth rotating shaft 260 is located below the line connecting the fifth rotating shaft 250 and the first rotating shaft 111, so that the rotation direction of the telescopic unit 170 acting on the first swing arm 130 is the same as the outward swing direction of the first swing arm 130 (i.e., the first direction). That is, the rotation direction of the telescopic unit 170 acting on the first swing arm 130 is the same as the first direction. At this time, the telescopic unit 170 functions to assist the first swing arm 130 to rotate in the first direction, to save the user's force required in the main lifting stage. For example, under light load conditions, the torque provided by the telescopic unit 170 can cause the storage portion 50 to swing directly from the first position to the second position without additional force from the user. Under heavy load conditions, the torque provided by the telescopic unit 170 can assist the user in swinging the storage portion 50 from the first position to the second position, reducing the force from the user, and thereby optimizing the user experience.

It should be added that, as shown in FIGS. 4-6, before the storage portion 50 moves to the first position, the swing portion 20 does not rotate in the first direction, and the first swing arm 130 is in contact with the second swing arm 140, that is, the parallelogram structure formed by the first swing arm 130 and the second swing arm 140 is currently in a dead center state, that is, in an extreme position. At this time, the swing portion 20 can only rotate in the first direction, and cannot rotate in the opposite direction to the first direction. That is to say, the above arrangement enables the user to prevent the swing portion 20 from rotating in the direction opposite to the first direction when the user pulls the storage portion 50, thereby preventing the sliding rail 210 from rotating in the direction opposite to the first direction, and preventing internal parts from interacting with each other.

Based on the above embodiments, preferably, the extension direction of the limiting groove 402 is opposite to the taking-out direction of the storage portion 50, that is, the extension direction of the limiting groove 402 is the same as the second direction, as shown in FIGS. 9-14. At this time, the user needs to push the storage portion 50 inwards, so that the limiting groove 402 moves to a position above the second guide post 312 in the direction opposite to the second direction, so as to lock the storage portion 50 in the height direction. In this case, when unlocking is required, the storage portion 50 needs to be pulled correspondingly, so that the limiting groove 402 moves in the second direction to the outside of the second guide post 312, which can prevent the storage portion 50 from being accidentally unlocked due to accidental touching during actual use. As other optional embodiment, the extension direction of the limiting groove 402 is opposite to the second direction.

In order to facilitate the understanding for those of ordinary skills in the art, the overall working process of the pivoting and lifting structure with push-pull locking will be explained below.

In the initial state, as shown in FIGS. 1-4, the storage portion 50 is stored in the housing 60, and the above-mentioned rotating assembly 10, sliding assembly 20, first trigger assembly 30, and second trigger assembly 40 are all in their respective initial states, In the first state, as shown in FIGS. 5-6, when the storage portion 50 extends out by a first distance and is in the first position, the pivoting and lifting structure with push-pull locking is in the first state. At this time, the second trigger assembly 40 and the storage portion 50 move for the first distance, the first guide post 311 is located at the inlet of the first guide groove 4011, and the first guide post 311 is located at the second notch 141*b* of the buffer groove 141. The third swing arm 150 swings outwards relative to the second swing arm 140 in the first direction.

Then, the storage portion 50 continues to be pulled to drive the swing portion 120 to rotate, so as to lift the storage portion 50 to the second position, so that the guide portion 31 slides or rolls along the guide groove 401, so that the storage portion 50 will not shake at the front and rear positions when it pivots upwards.

In the transition state, as shown in FIGS. 7-8, the storage portion 50 is pulled, and the sliding portion 220 rotates outwards to the transition position along with the first swing arm 130 and the second swing arm 140. At this time, the first guide post 311 always slides or rolls in the first guide groove 4011, and the second guide post 312 enters the inlet of the second guide groove 4012.

In the second state, as shown in FIGS. 9-10, the storage portion 50 is pulled, and the sliding portion 220 rotates outwards to the second position (the highest position of the storage portion 50) with the first swing arm 130 and the second swing arm 140. At this time, the first guide post 311 is still sliding or rolling in the first guide groove 4011, but the second guide post 312 is located at the junction of the second guide groove 4012 and the limiting groove 402, that is, at the inlet of the limiting groove 402, the swing portion 120 is limited by the limiting portion 113.

In the third state (that is, the light-load locking position), as shown in FIGS. 11-12, the storage portion 50 is pushed inwards, so that the limiting groove 402 moves in the direction opposite to the second direction to a position above the second guide post 312, to achieve locking of the storage portion 50 in the height direction. At this time, the storage portion 50 and the items inside have a lower weight, and the locking of the storage portion 50 can be completed only by the elastic force provided by the telescopic unit 170. Therefore, the second guide post 312 is not in contact with the groove wall of the limiting groove 402, which prevents the storage portion 50 from accidentally falling under force.

In the fourth state (that is, the heavy-load locking position), as shown in FIGS. 13-14, the storage portion 50 is pushed inwards, so that the limiting groove 402 moves in the direction opposite to the second direction to a position above the second guidepost 312, to achieve locking of the storage portion 50 in the height direction. At this time, the storage portion 50 and the items inside have a heavier weight. Therefore, the second guide post 312 is in contact with the groove wall of the limiting groove 402 to assist the telescopic unit 170 in locking the position of the storage portion 50.

To sum up, the pivoting and lifting structure with push-pull locking in this embodiment has the advantages of low cost, high stability, high precision, and good user experience.

Embodiment Two

This embodiment provides a dishwasher, which specifically includes a housing 60, a storage portion 50, and a pivoting and lifting structure with push-pull locking of Embodiment One mounted in the housing 60. The storage portion 50 is a rack. The specific structure and technical effects of the pivoting and lifting structure with push-pull locking are described in Embodiment One. The dishwasher in this embodiment includes this structure and also has its technical effects.

To sum up, the dishwasher in this embodiment has the advantages of low cost, high stability, high precision, and good user experience.

Embodiment Three

This embodiment provides a household appliance, which may be a dishwasher, an oven, a cabinet, a refrigerator, etc., specifically including a housing 60, a storage portion 50, and a pivoting and lifting structure with push-pull locking in Embodiment One mounted in the housing 60. The storage portion 50 is a container structure such as a rack or baking pan. The specific structure and technical effects of the pivoting and lifting structure with push-pull locking are described in Embodiment One. The household appliance in this embodiment includes this structure and also has its technical effects.

To sum up, the household appliance in this embodiment has the advantages of low cost, high stability, high precision, and good user experience.

As mentioned above, the above embodiments are only used to illustrate the technical solution of the present disclosure, rather than limiting the present disclosure. Although the present disclosure has been described in detail with reference to the foregoing embodiments, those of ordinary skill in the art will understand that it is still possible to modify the technical solutions recorded in the foregoing embodiments, or to equivalently replace some of the technical features. However, these modifications or replacements do not cause the essence of the corresponding technical solution to deviate from the gist and scope of the technical solution of each embodiment of the present disclosure.

What is claimed is:

1. A pivoting and lifting structure with push-pull locking, comprising:

a rotating assembly configured with a base portion and a swing portion, wherein the swing portion is hinged to the base portion and is rotatable around the base portion;

a sliding assembly comprising a sliding rail slidingly hinged to the swing portion, and a sliding portion connected to the sliding rail;

a first trigger assembly comprising a guide portion fixedly connected to the swing portion;

a second trigger assembly fixedly connected to the sliding portion and provided with a guide groove and a limiting groove corresponding to the guide portion;

wherein the sliding portion or the second trigger assembly is used to set a storage portion; the guide groove extends in a first direction so that the guide portion is capable of sliding or rolling along the guide groove when the swing portion rotates; and an extension direction of the limiting groove does not coincide with an extension direction of the guide groove at an outlet;

when the sliding portion extends out by a first distance and is in a first position, the guide portion is located at an inlet of the guide groove;

when the guide portion slides or rolls along the guide groove for a second distance and is in a second position, the guide portion is located at an inlet of the limiting groove; and when the guide portion is in a locking position, the guide portion is at least partially located in the limiting groove.

2. The pivoting and lifting structure with push-pull locking according to claim 1, wherein the guide portion comprises a first guide post and a second guide post, and the guide groove comprises a first guide groove corresponding to the first guide post and a second guide groove corresponding to the second guide post;

when the sliding portion extends out by the first distance and is in the first position, the first guide post is located at an inlet of the first guide groove and is in contact with a groove wall of the first guide groove at the inlet, and the second guide post is not in contact with the second guide groove;

when the guide portion slides or rolls along the guide groove for the second distance and is in the second position, the second guide post is located in the second guide groove.

3. The pivoting and lifting structure with push-pull locking according to claim 2, wherein the limiting groove is opened in a groove wall of the second guide groove;

when the guide portion slides or rolls along the guide groove for the second distance and is in the second position, the second guide post is capable of sliding into the limiting groove.

4. The pivoting and lifting structure with push-pull locking according to claim 2, wherein the swing portion comprises a first swing arm and a second swing arm rotationally connected to the base portion, and an end of the first swing arm and an end of the second swing arm are respectively hinged to the sliding rail;

wherein hinge points of the first swing arm and the second swing arm on the base portion, and hinge points of the first swing arm and the second swing arm on the sliding rail form a parallelogram.

5. The pivoting and lifting structure with push-pull locking according to claim 4, wherein the second swing arm is provided with a corresponding buffer groove, a third swing arm is further rotationally connected to the second swing arm, the first guide post is mounted on the third swing arm, and the first guide post is slidingly connected to the buffer groove; and the second guide post is mounted on the second swing arm;

a reset unit is connected between the second swing arm and the third swing arm, wherein the reset unit is used to pull the third swing arm in a direction towards the second swing arm so that the first guide post is located in a first notch of the buffer groove; and when the sliding portion extends out by the first distance and is in the first position, the first guide post is pushed by the groove wall of the first guide groove, so that the first guide post is located in a second notch of the buffer groove.

6. The pivoting and lifting structure with push-pull locking according to claim 4, wherein the base portion is further rotationally connected with a telescopic unit, and a telescopic end of the telescopic unit is rotationally connected with the first swing arm; and wherein a rotation direction of the telescopic unit acting on the first swing arm is opposite to an outward swing direction of the first swing arm before the sliding portion rotates by a first angle in the first direction;

after the sliding portion rotates by the first angle in the first direction, the rotation direction of the telescopic unit acting on the first swing arm is the same as the outward swing direction of the first swing arm.

7. The pivoting and lifting structure with push-pull locking according to claim 4, wherein the base portion is provided with a limiting portion for limiting rotation of the swing portion; and before the sliding portion moves to the first position, the first swing arm is at least partially in contact with the second swing arm for limiting rotation of the swing portion in the direction opposite to the first direction.

8. The pivoting and lifting structure with push-pull locking according to claim 1, wherein the extension direction of the limiting groove is opposite to a taking-out direction of the storage portion.

9. A household appliance, comprising a storage portion and the pivoting and lifting structure with push-pull locking according to claim 1, wherein the storage portion is a rack or a baking pan.

10. A dishwasher, comprising:

a storage portion, wherein the storage portion is a dishwasher rack; and a pivoting and lifting structure with push-pull locking, comprising:

a rotating assembly configured with a base portion and a swing portion, wherein the swing portion is hinged to the base portion and is rotatable around the base portion;

a sliding assembly comprising a sliding rail slidingly hinged to the swing portion, and a sliding portion connected to the sliding rail;

a first trigger assembly comprising a guide portion fixedly connected to the swing portion;

a second trigger assembly fixedly connected to the sliding portion and provided with a guide groove and a limiting groove corresponding to the guide portion;

wherein the sliding portion or the second trigger assembly is used to set a storage portion; the guide groove extends in a first direction so that the guide portion is capable of sliding or rolling along the guide groove when the swing portion rotates; and an extension direction of the limiting groove does not coincide with an extension direction of the guide groove at an outlet;

when the sliding portion extends out by a first distance and is in a first position, the guide portion is located at an inlet of the guide groove;

when the guide portion slides or rolls along the guide groove for a second distance and is in a second position, the guide portion is located at an inlet of the limiting groove; and when the guide portion is in a locking position, the guide portion is at least partially located in the limiting groove.

11. The dishwasher according to claim 10, wherein the guide portion comprises a first guide post and a second guide post, and the guide groove comprises a first guide groove corresponding to the first guide post and a second guide groove corresponding to the second guide post;

when the sliding portion extends out by the first distance and is in the first position, the first guide post is located at an inlet of the first guide groove and is in contact with a groove wall of the first guide groove at the inlet, and the second guide post is not in contact with the second guide groove;

when the guide portion slides or rolls along the guide groove for the second distance and is in the second position, the second guide post is located in the second guide groove.

12. The dishwasher according to claim 11, wherein the limiting groove is opened in a groove wall of the second guide groove;

when the guide portion slides or rolls along the guide groove for the second distance and is in the second position, the second guide post is capable of sliding into the limiting groove.

13. The dishwasher according to claim 11, wherein the swing portion comprises a first swing arm and a second swing arm rotationally connected to the base portion, and an end of the first swing arm and an end of the second swing arm are respectively hinged to the sliding rail;

wherein hinge points of the first swing arm and the second swing arm on the base portion, and hinge points of the first swing arm and the second swing arm on the sliding rail form a parallelogram.

14. The dishwasher according to claim 13, wherein the second swing arm is provided with a corresponding buffer groove, a third swing arm is further rotationally connected to the second swing arm, the first guide post is mounted on the third swing arm, and the first guide post is slidingly connected to the buffer groove; and the second guide post is mounted on the second swing arm;

a reset unit is connected between the second swing arm and the third swing arm, wherein the reset unit is used to pull the third swing arm in a direction towards the second swing arm so that the first guide post is located in a first notch of the buffer groove; and when the sliding portion extends out by the first distance and is in the first position, the first guide post is pushed by the groove wall of the first guide groove, so that the first guide post is located in a second notch of the buffer groove.

15. The dishwasher according to claim 13, wherein the base portion is further rotationally connected with a telescopic unit, and a telescopic end of the telescopic unit is rotationally connected with the first swing arm; and wherein a rotation direction of the telescopic unit acting on the first swing arm is opposite to an outward swing direction of the first swing arm before the sliding portion rotates by a first angle in the first direction;

after the sliding portion rotates by the first angle in the first direction, the rotation direction of the telescopic unit acting on the first swing arm is the same as the outward swing direction of the first swing arm.

16. The dishwasher according to claim 13, wherein the base portion is provided with a limiting portion for limiting rotation of the swing portion; and before the sliding portion moves to the first position, the first swing arm is at least partially in contact with the second swing arm for limiting rotation of the swing portion in the direction opposite to the first direction.

17. The dishwasher according to claim 10, wherein the extension direction of the limiting groove is opposite to a taking-out direction of the storage portion.

* * * * *